US005538829A

United States Patent [19]

Ong et al.

[11] Patent Number: 5,538,829

[45] Date of Patent: Jul. 23, 1996

[54] TONER COMPOSITIONS WITH ZINC AND BORON CHARGE ENHANCING ADDITIVES

[75] Inventors: Beng S. Ong, Mississauga; H. Bruce Goodbrand, Hamilton, both of Canada

[73] Assignee: Xerox Corporation, Stamford, Conn.

[21] Appl. No.: 523,573

[22] Filed: Sep. 5, 1995

[51] Int. Cl.[6] ..... G03G 9/097

[52] U.S. Cl. ..... 430/110; 430/106

[58] Field of Search ..... 430/106, 106.6, 430/110, 109

[56] References Cited

U.S. PATENT DOCUMENTS

| | | | |
|---|---|---|---|
| 4,898,802 | 2/1990 | Hsieh et al. | 430/110 |
| 5,256,515 | 10/1993 | Law et al. | 430/110 |
| 5,300,387 | 4/1994 | Ong | 430/110 |
| 5,302,481 | 4/1994 | Ong | 430/106 |
| 5,403,689 | 4/1995 | Odell et al. | 430/110 |
| 5,409,794 | 4/1995 | Ong | 430/110 |
| 5,451,482 | 9/1995 | Law et al. | 430/110 |

*Primary Examiner*—John Goodrow
*Attorney, Agent, or Firm*—E. O. Palazzo

[57] ABSTRACT

A negatively charged toner composition comprised of a polymer resin or polymer resins, colorants comprised of pigment particles and/or dyes, optional surface additives, and a boron charge enhancing additive obtained from the reaction of an alkylboric acid or an arylboric acid and an N-alkyl- or N-aryl-substituted bis(hydroxyalkyl)amine, or a zinc charge enhancing additive obtained from the reaction of an aromatic carboxylic acid and an N-alkyl- or N-aryl-substituted bis(hydroxyalkyl)amine with a zinc ion-containing compound in aqueous medium.

26 Claims, No Drawings

TONER COMPOSITIONS WITH ZINC AND BORON CHARGE ENHANCING ADDITIVES

BACKGROUND OF THE INVENTION

The invention is generally directed to toner and developer compositions, and more specifically, the present invention is directed to developer and toner compositions containing charge enhancing additives, which impart or assist in imparting a negative charge to the toner particles and enable toners with rapid triboelectric charging characteristics. In embodiments, there are provided in accordance with the present invention toner compositions comprised of a polymer or polymer resins, colorants, such as pigment particles or dye molecules, and certain aluminum or boron charge enhancing additives having a structural moiety derived from N-alkyl or N-aryl bis(hydroxyalkyl)amine. In embodiments, the present invention is directed to toners with certain zinc or boron compounds which enhance or improve the toner's triboelectric charging performance. The zinc compounds are generally prepared by treating a suspension of an aromatic carboxylic acid, preferably hydroxybenzoic acid in an aqueous medium containing a molar equivalent of zinc ion with two or more molar equivalents of a bis(hydroxyalkyl)amine at a temperature ranging from ambient, about 25° C. to about 100° C. The boron compounds can be obtained by the reaction of an alkyl or arylboric acid with an equimolar quantity of a bis(hydroxyalkyl)amine, preferably N-aryl bis(hydroxyethyl)amine, at an elevated temperature, for example from about 75° C. to about 100° C. with azeotropic removal of the water byproduct. The aforementioned charge additives in embodiments of the present invention enable, for example, toners with rapid triboelectric charging characteristics, extended developer life, stable triboelectrical properties irrespective of changes in environmental conditions, and high print quality with substantially no background development. Also, the aforementioned toner compositions usually contain a colorant component comprised of, for example, carbon black, magnetites, or mixtures thereof, color pigments or dyes such as cyan, magenta, yellow, blue, green, red, or brown color, or mixtures thereof thereby providing for the development and generation of black and/or colored images. The toner and developer compositions of the present invention can be selected for electrophotographic, especially xerographic, imaging and printing processes, including color processes. These charge enhancing compounds are believed to have an intramolecular complex or salt structure having a central metal ion, and a quaternary ammonium ligand. Accordingly, the structure of these charge enhancing additives in embodiments are believed to be represented by the general structures (Ia) and (Ib):

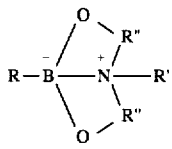

(Ia)

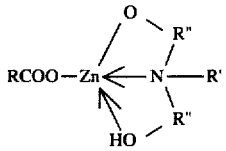

(Ib)

where R and R' are independently selected from alkyl of 1 to about 20 carbon atoms and aryl of from 6 to about 30 carbon atoms; and R" is an alkylene with from 1 to about 5 carbon atoms, and more specifically, methylene groups.

Toners with negative charge additives are known, reference for example U.S. Pat. Nos. 4,411,974 and 4,206,064, the disclosures of which are totally incorporated herein by reference. The '974 patent discloses negatively charged toner compositions comprised of resins, pigment particles, and as a charge enhancing additive ortho-halophenyl carboxylic acids. Similarly, there are disclosed in the '064 patent toner compositions with chromium, cobalt, and nickel complexes of salicylic acid as negative charge enhancing additives. In U.S. Pat. No. 4,845,003, there are illustrated negatively charged toners with certain aluminum salt charge additives. More specifically, this patent discloses as charge additives aluminum complexes comprised of two or three hydroxybenzoic acid ligands bonded to a central aluminum ion. While these charge additives may have the capability of imparting negative triboelectric charge to toner particles, they are generally not efficient in promoting the rate of triboelectric charging of toner particles. A fast rate of charging is particularly crucial for high speed xerographic machines since, for example, these machines consume toner rapidly, and fresh toner has to be constantly added. The added uncharged toners, therefore, must charge up to their equilibrium triboelectric charge level rapidly to ensure no interruption in the xerographic imaging or printing operation. Another shortcoming of these charge additives is their thermal instability, that is they often break down during the thermal extrusion process of the toner manufacturing cycle. Most or many of these and other disadvantages are eliminated, or substantially eliminated with the zinc complex charge additives of the present invention.

Toner compositions with other negative charge enhancing additives include, for example, U.S. Pat. Nos. 5,300,387 and 5,302,481, the disclosures of which are totally incorporated herein by reference. Specifically, the '387 patent discloses toner compositions comprised of a toner resin, a colorant, optional surface additives, and a metal complex charge additive derived from the reaction of a dicarboxylic acid and a hydroxybenzoic acid with a metal ion. Structurally, these charge enhancing additives are anionic metal complexes containing an anion comprised of a central metal ion, such as aluminum, gallium, zinc, cobalt ion and the like, bonded to two different bidentate ligands derived from an aromatic dicarboxylic acid and a hydroxybenzoic acid, and a countercation of proton, ammonium ion, alkaline metal cation or the like. Similarly, the '481 patent describes toner compositions with aluminum charge additives with mixed ligands derived from hydroxyphenol and hydroxybenzoic acid. While these charge additives are effective in imparting negative charge to toners, their rates of charging are generally not as rapid as those of the additives of the present invention, and their preparative processes are not as simple. Another advantage of the charge additives of the present invention is that can be obtained from economical precursors. There are also disclosed in U.S. Pat. No. 5,409,794, the disclosure of which is totally incorporated herein by reference, toner compositions containing negative charge additives derived from the reaction of a metal, a metal carbonyl, a metal salt, or a metal oxide with a β-diketone, a β-keto ester, or a malonic ester in an aqueous or organic medium. These charge additives render toner compositions negative in triboelectric charging, but their charging rates are generally slower than those of the charge additives of the present invention.

Developer compositions with charge enhancing additives, which impart a positive charge to the toner particles, are also well known. Thus, for example, there is described in U.S. Pat. No. 3,893,935, the disclosure of which is totally incorporated herein by reference, the use of quaternary ammonium salts as charge control agents for electrostatic toner compositions; U.S. Pat. No. 4,221,856, the disclosure of which is totally incorporated herein by reference, which discloses electrophotographic toners containing resin compatible quaternary ammonium compounds; U.S. Pat. No. 4,338,390, the disclosure of which is totally incorporated herein by reference, discloses developer compositions containing as charge enhancing additives organic sulfate and sulfonates, which additives can impart a positive charge to the toner composition; and U.S. Pat. No. 4,298,672, the disclosure of which is totally incorporated herein by reference, discloses positively charged toner compositions with resins and pigment particles, and as charge enhancing additives alkyl pyridinium compounds.

U.S. Pat. No. 5,275,900, the disclosure of which is totally incorporated herein by reference, describes toner and developer compositions containing metal complex charge additives, which are anionic in nature. More specifically, disclosed in this patent is a negatively charged toner composition comprised of a polymer or polymer resins, a colorant or colorants, optional surface additives, and a metal complex charge enhancing additive obtained from the reaction of a hydroxybenzoic acid and a base with a mixture of a metal ion and a hydroxyphenol; and a negatively charged toner composition comprised of a polymer or polymers, a colorant or colorants, optional surface additives, and a metal complex charge enhancing additive obtained from the reaction of a hydroxybenzoic acid and a base with a mixture of a metal ion and an aromatic dicarboxylic acid. These complexes are comprised of an anion with two bidentate ligands chelating to a central metal, and countercations of protons, alkaline metal ions, ammonium ions, and the like.

U.S. Pat. No. 5,290,651 discloses another class of charge enhancing additives which are based on zinc complexes of hydroxybenzoic acid and hydroxyphenol, the disclosures of which are totally incorporated herein by reference. Specifically, these complexes, when incorporated into toner compositions comprised of a polymer or polymer resins, a colorant or colorants, optional surface additives, and a zinc complex enhanced the level of negative triboelectric charge of the toner compositions.

Additionally, novel metal complex negative charge enhancing additives for toner compositions are disclosed in U.S. Pat. Nos. 5,300,387; 5,302,481 and 5,332,636, the disclosures of which are totally incorporated herein by reference. These complexes have the capability of being able to enhance both the rate of charging and the negative triboelectric charge levels of toner compositions.

Although many charge enhancing additives are known, there continues to be a need for charge enhancing additives which, when incorporated in toners, provide toners with many of the advantages illustrated herein. There is also a need for negative charge enhancing additives which are useful for incorporation into black and colored toner compositions which can be utilized for developing positive electrostatic latent images. Moreover, there is a need for colored toner compositions containing charge enhancing additives which do not interfere with the color quality of the colorants present in the toners. Another need relates to the provision of toner compositions with certain charge enhancing additives, which toners in embodiments thereof possess substantially stable triboelectric charge levels, and display acceptable rates of triboelectric charging characteristics. Furthermore, there is also a need for toner compositions with certain charge enhancing additives which possess excellent dispersibility characteristics in toner resins, and can, therefore, form stable dispersions in the toner compositions. There is also a need for negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for negative toner compositions which have desirable triboelectric charge levels of, for example, from between about −10 to about −40 microcoulombs per gram, and preferably from about −10 to about −25 microcoulombs per gram, and triboelectric charging rates of less about 60 seconds, and preferably less than 45 seconds as measured by standard charge spectrograph methods when the toners are frictionally charged against suitable carrier particles via conventional roll milling techniques. There is also a need for environmentally compatible charge enhancing additives which when incorporated at effective concentrations of, for example, less than 10 weight percent, preferably less than 5 weight percent in toners, provide toners that are environmentally acceptable. An additional need resides in the provision of simple and cost-effective preparative processes for the charge enhancing additives of the present invention. The concentrations of the charge additives that can be incorporated into the toner compositions generally range from about 0.05 weight percent to about 10 weight percent, depending on whether the charge additive is utilized as a surface additive or as a dispersion in the bulk of the toner. The effective concentrations of toner in the developer, that is toner and carrier particles, are, for example, from about 0.5 to about 5 weight percent, preferably from about 1 to about 3 weight percent.

Illustrated in copending patent applications U.S. Ser. No. 523,576, filed Sep. 5, 1995, is a toner composition comprised of toner resins, colorants, optional surface additives, and a charge enhancing additive obtained from the reaction of an aluminum ion-containing compound with a molar equivalent of an aromatic carboxylic acid, and an excess of an N-alkyl or N-aryl-substituted bis(hydroxyalkyl)amine in an aqueous medium at a temperature ranging from about 25° C. to about 100° C.; and U.S. Ser. No. 523,577, filed Sep. 5, 1995, is a negatively charged toner composition comprised of toner resins, colorants, optional surface additives, and a metal charge enhancing additive obtained from the reaction of a metal ion with a molar equivalent of an ortho-hydroxyphenol and two molar equivalents of an aromatic carboxylic acid in an aqueous medium in the presence of a base, the disclosures of which are totally incorporated herein by reference.

SUMMARY OF THE INVENTION

Examples of objects of the present invention include:

It is an object of the present invention to provide toner and developer compositions with negative charge enhancing additives.

In another object of the present invention there are provided negatively charged toner compositions useful for the development of electrostatic latent images including color images.

In yet a further object of the present invention there may be provided, it is believed, humidity insensitive, from about, for example, 20 to 80 percent relative humidity at temperatures of from 60° to 80° F. as determined in a relative humidity testing chamber, negatively charged toner compositions with desirable triboelectric charging rates of less than 120 seconds, and preferably less than 60 seconds as determined by the charge spectrograph method, and acceptable triboelectric charging levels of from about −10 to about −40 microcoulombs per gram.

Another object of the present invention resides in the preparation of negative toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is for example those exceeding 50 copies per minute.

A further object is to provide a simple and cost-effective process for the preparation of boron and zinc charge enhancing additives, and which additives are considered metal complexes with mixed ligands of hydrobenzoic acids and bis(hydroxyalkyl) amines.

These and other objects of the present invention may be accomplished in embodiments thereof by providing toner compositions comprised of a polymer resin or polymer resins, colorants comprised of color pigment particles or dye molecules, and certain boron or zinc charge enhancing additives. The boron salt charge additives are obtained from the reaction of alkyl or arylboric acid with a substituted bis(hydroxyalkyl)amine while the zinc complex charge enhancing additives are derived from the reaction of an aromatic carboxylic acid, preferably hydroxybenzoic acid, with a molar equivalent of zinc ion and two or more molar equivalents of a bis(hydroxyalkyl)amine. More specifically, the present invention in embodiments is directed to toner compositions comprised of resin particles, pigment, or dye, and negative charge enhancing additives which may be structurally represented by the formulas (II) and (III)

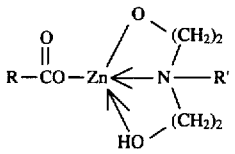

(II)

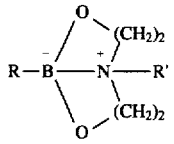

(III)

wherein R and R' are independently selected from the group consisting of alkyl with, for example, 1 to about 25 carbon atoms, and aryl with, for example, from 6 to about 30 carbon atoms. Illustrative examples of alkyl include methyl, ethyl, propyl, butyl, pentyl, hexyl, heptyl, and the like, while Illustrative examples of aryl include phenyl, hydroxyphenyl, chlorophenyl, fluorophenyl, cyanophenyl, tolyl, naphthyl (Nap), and the like.

Embodiments of the present invention include a negatively charged toner composition comprised of a polymer resin or polymer resins, colorants comprised of pigment particles and/or dyes, optional surface additives, and a boron charge enhancing additive obtained from the reaction of an alkylboric acid or an arylboric acid and an N-alkyl- or N-aryl-substituted bis(hydroxyalkyl)amine, or a zinc charge enhancing additive obtained from the reaction of an aromatic carboxylic acid and an N-alkyl- or N-aryl-substituted bis(hydroxyalkyl)amine with a zinc ion-containing compound in aqueous medium; a negatively charged toner composition comprised of resin, pigment, optional surface additives, and a boron or zinc charge enhancing additive represented by the formulas (Ia) or (Ib) wherein, for example, R and R' are independently selected from the group consisting of alkyl of from 1 to about 20 carbon atoms, and aryl of from 6 to about 30 carbon atoms; and R" is methylene, propylene, ethylene, butylene, or pentylene.

The aforementioned charge additives can be incorporated into the toner, may be present on the toner surface, or may be present on toner surface additives such as colloidal silica particles. Advantages of rapid triboelectric charging characteristics of generally less than 60 seconds, for example from about 15 to about 30 seconds, and preferably less than 45 seconds in embodiments as measured by the standard charge spectrograph methods when the toner particles are frictionally charged against carrier particles by known conventional roll mixing methods, appropriate triboelectric charge levels, and the like can be achieved with many of the aforementioned toners of the present invention. In another embodiment of the present invention, there are provided, subsequent to known micronization and classification, toner particles containing charge enhancing additives of the present invention with a volume average diameter of from about 2 to about 20 microns.

The zinc charge additives of the present invention can be prepared by treating a well stirred suspension of an aromatic acid in an aqueous medium containing a molar equivalent of zinc ion with two or more molar equivalents of an N-alkyl or N-aryl-substituted bis(hydroxyalkyl)amine. Specifically, the synthesis can be accomplished by a dropwise addition of two or more molar equivalents of the substituted bis(hydroxyethyl)amine to a well stirred suspension of a molar equivalent of an aromatic acid in an aqueous medium containing one molar equivalent of zinc sulfate at a temperature of 40° to 90° C. over a period of from a bout 15 to 30 minutes. After the addition, the reaction mixture is stirred at the same temperature, 40° to 90° C., for another period of 15 minutes to about 10 to 15 hours. The reaction product is then filtered, and washed with water, and then the product is dried in a vacuum.

The born additives of the present invention can be prepared by refluxing a substituted boric acid, preferably arylboric acid with an equimolar quantity of an N-alkyl or N-aryl-substituted bis(hydroxyalkyl)amine in an organic solvent like toluene with azeotropic removal of water. The reaction process is simple, and the yield is over 95 percent in embodiments.

The toner compositions of the present invention can be prepared by a number of known methods such as admixing and heating resin, such as styrene butadiene copolymers, colorants such as color pigment particles or dye compounds, and the aforementioned metal complex charge enhancing additive, or mixtures of charge additives in a concentration preferably ranging from about 0.5 percent to about 5 percent in a toner extrusion device, such as the ZSK53 available from Werner Pfleiderer, and removing the resulting toner composition from the device. Subsequent to cooling, the toner composition is subjected to grinding utilizing, for example, a Sturtevant micronizer for the purpose of achieving toner particles with a volume average diameter of from about 2 to about 25 microns, and preferably from about 3 to about 12 microns, which diameters are determined by a Coulter Counter. Subsequently, the toner compositions can be classified utilizing, for example, a Donaldson Model B classifier for the purpose of removing unwanted fine toner particles.

Illustrative examples of suitable toner resins selected for the toner and developer compositions of the present invention include thermoplastic resins, such as vinyl polymers such as styrene polymers, acrylonitrile polymers, vinyl ether polymers, acrylate and methacrylate polymers; styrene acrylates, styrene methacrylates, styrene butadienes; epoxy polymers; polyurethanes; polyamides and polyimides; polyesters; and the like. The polymer resins selected for the toner compositions of the present invention include homopolymers or copolymers of two or more monomers. Furthermore, the above mentioned resins may also be crosslinked depending on the desired toner properties. Illustrative vinyl monomer units in the vinyl polymers include styrene, substituted styrenes, such as methyl styrene, chlorostyrene, methyl acrylate and methacrylate, ethyl acrylate and methacrylate, propyl acrylate and methacrylate, butyl acrylate and methacrylate, pentyl acrylate and methacrylate, butadiene, vinyl chloride, acrylonitrile, acrylamide, alkyl vinyl ether and the like. Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, cyclopentanediols, bis(hydroxyphenyl)alkanes, dihydroxybiphenyl, substituted dihydroxybiphenyls, and the like. Generally, the resins selected are known and include styrene acrylates, styrene methacrylates, styrene butadienes, and polyesters, including polyesterimides and the polyesters of U.S. Pat. No. 5,227,460, the disclosure of which is totally incorporated herein by reference.

In embodiments, there are selected polyester resins derived from a dicarboxylic acid and a diphenol, reference U.S. Pat. No. 3,590,000, the disclosure of which is totally incorporated herein by reference; polyester resins obtained from the reaction of bisphenol A and propylene oxide, followed by the reaction of the resulting product with fumaric acid, and branched polyester resins resulting from the reaction of dimethylterephthalate with 1,3-butanediol, 1,2-propanediol, and pentanetriol. Other specific toner resins include styrene-methacrylate copolymers and styrene-butadiene copolymers; PLIOLITES®; suspension polymerized styrene-butadienes, reference U.S. Pat. No. 4,558,108, the disclosure of which is totally incorporated herein by reference. Also, waxes with a molecular weight of from about 1,000 to about 7,000, such as polyethylene, polypropylene, and paraffin waxes, can be included in, or on the toner compositions as fuser roll release agents.

The toner resins are present in a sufficient, but effective amount, for example from about 50 to about 95 weight percent. Thus, when 1 percent by weight of the charge enhancing additive is present, and 11 percent by weight of colorant, such as carbon black or color pigment, is contained therein, about 88 percent by weight of resin is selected. Also, the charge enhancing additive of the present invention may be applied as a surface coating on the toner particles. When used as a coating, the charge enhancing additive of the present invention is present in an amount of from about 0.05 weight percent to about 5 weight percent, and preferably from about 0.1 weight percent to about 1.0 weight percent. Generally, the charge additive is present in an amount of from about 0.05 to about 10 weight percent based on the weight of the toner of resin, pigment, and charge additive.

Numerous well known suitable color pigments or dyes can be selected as the colorant for the toner compositions including, for example, carbon black like REGAL 330®, nigrosine dye, metal phthalocyanines, aniline blue, magnetite, or mixtures thereof. The colorant, which is preferably carbon black or other color pigments, should be present in a sufficient amount to render the toner composition with a sufficiently high color intensity. Generally, the colorants are present in amounts of from about 1 weight percent to about 20 weight percent, and preferably from about 2 to about 10 weight percent based on the total weight of the toner composition; however, lesser or greater amounts of colorant can be selected.

When the colorants are comprised of magnetites or a mixture of magnetites and color pigment particles, thereby enabling single component toners and toners for magnetic ink character recognition (MICR) applications in some instances, which magnetites are a mixture of iron oxides ($FeO.Fe_2O_3$) including those commercially available as MAPICO BLACK®, they are present in the toner composition in an amount of from about 5 weight percent to about 60 weight percent, and preferably in an amount of from about 10 weight percent to about 50 weight percent. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected for black toner compositions of the present invention.

There can also be blended with the toner compositions of the present invention external additives including flow aid additives, which additives are usually present on the surface thereof. Examples of these additives include colloidal silicas, such as AEROSIL®, metal salts, metal oxides, and metal salts of fatty acids inclusive of zinc stearate, aluminum oxides, cerium oxides, titanium oxides, and mixtures thereof, which additives are generally present in an amount of from about 0.1 percent by weight to about 5 percent by weight, and preferably in an amount of from about 0.5 percent by weight to about 2 percent by weight. Several of the aforementioned additive are illustrated in U.S. Pat. Nos. 3,590,000 and 3,800,588, the disclosure of which are totally incorporated herein by reference.

With further respect to the present invention, colloidal silicas, such as AEROSIL®, can be surface treated with the metal complex charge additives of the present invention illustrated herein in an amount of from about 1 to about 50 weight percent and preferably 10 weight percent to about 25 weight percent, followed by the addition thereof to the toners in an amount of from 0.1 to 10 and preferably 0.1 to 5 weight percent.

Also, there can be included in the toner compositions of the present invention low molecular weight waxes, such as polypropylenes and polyethylenes commercially available from Allied Chemical and Petrolite Corporation, EPOLENE N-15R™ commercially available from Eastman Chemical Products, Inc., VISCOL 550-P™, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 7,000. Many of the polyethylene and polypropylene compositions useful in the present invention are illustrated in British Patent No. 1,442,835, the disclosure of which is totally incorporated herein by reference. These low molecular weight wax materials are present in the toner composition of the present invention in various amounts, however, generally these waxes are present in the toner composition in an amount of from about 1 percent by weight to about 15 percent by weight, and preferably in an amount of from about 2 weight percent to about 10 weight percent.

Included within the scope of the present invention are colored toner and developer compositions comprised of toner resins, optional surface additives, the charge enhancing additives illustrated herein, and as colorants red, blue, green, brown, magenta, cyan and/or yellow dyes or color pigments, as well as mixtures thereof. More specifically, with regard to the generation of color images utilizing a developer composition with the charge enhancing additives of the present invention, illustrative examples of magenta colorants that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan colorants that may be used include copper phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow colorants that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts providing the objectives of the present invention are achieved. In one embodiment, these colorants are present in the toner composition in an amount of from about 1 percent by weight to about 15 percent by weight based on the total weight of the toner.

For the formulation of developer compositions, there are mixed with the toner particles carrier components, particularly those that are capable of triboelectrically assuming an opposite polarity to that of the toner composition. Accordingly, the carrier particles of the present invention are selected to be those that would render the toner particles negatively charged while acquiring a positive charge polarity themselves via frictional charging against the toner particles of the present invention. The opposite charge polarities of the carrier and toner particles of the developer composition thus ensure the toner particles to adhere to and surround the carrier particles. Illustrative examples of carrier particles include iron powder, steel, nickel, iron, ferrites, including copper zinc ferrites, nickel zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxysilane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances, such as carbon black, in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 25 to about 500 microns, and preferably from between about 40 and 100 microns in volume average diameter thereby permitting them, for example, to possess sufficient density and inertia to avoid adherence to the electrostatic images during the development process. The carrier component can be mixed with the toner composition in various suitable combinations, such as about 1 to about 5 parts of toner by weight per 100 parts by weight of carrier.

The toner composition of the present invention can be prepared by a number of known methods including extrusion melt blending the toner resins, colorants, and the metal complex charge enhancing additive of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be first prepared, followed by addition of the charge enhancing additives and other optional surface additives, or the charge enhancing additive treated surface additives such as colloidal silicas. Further, other methods of preparation for the toner are as illustrated herein.

The toner and developer compositions of the present invention may be selected for use in electrostatographic imaging apparatuses containing therein photoreceptors, or photoconductive imaging members, reference for example U.S. Pat. No. 4,265,990, the disclosure of which is totally incorporated herein by reference, providing, for example, that they are capable of forming positive electrostatic latent images relative to the triboelectric charge polarity of the toners.

The toners of the present invention are usually jetted and classified subsequent to preparation to enable toner particles with a preferred volume average diameter of from about 2 to about 25 microns, and more preferably from about 3 to about 12 microns. The triboelectric charging rates for the toners of the present invention are preferably less than 60 seconds, and more specifically, less than 45 seconds in embodiments thereof as determined by the known charge spectrograph method as described hereinbefore. These toner compositions with rapid rates of triboelectric charging characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 50 copies per minute.

Examples of specific charge additives of the present invention are represented by Formulas (IV) through (XXI):
(IV)
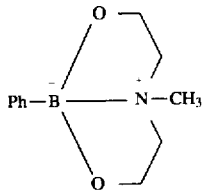
(V)
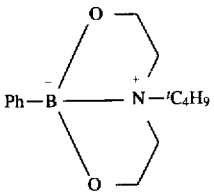
(VI)
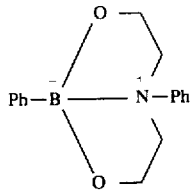
(VII)
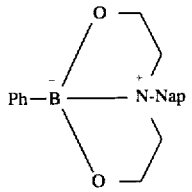
(VIII)
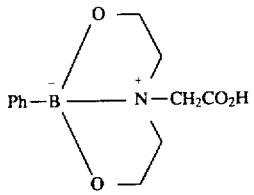
(IX)
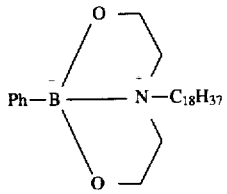
(X)
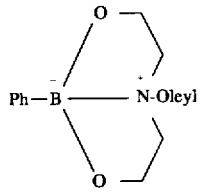
(XI)
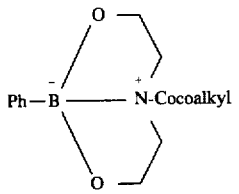
-continued
(XII)
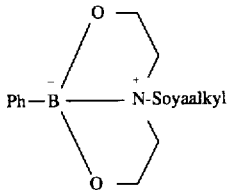
(XIII)
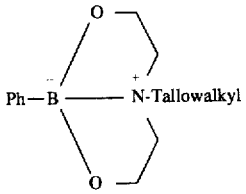
(XIV)
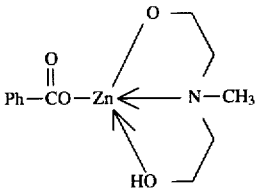
(XV)
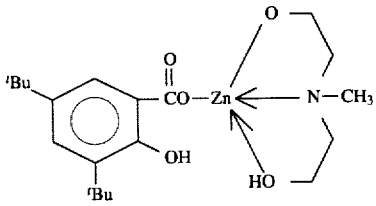
(XVI)
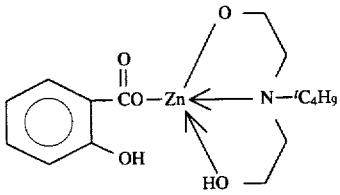
(XVII)
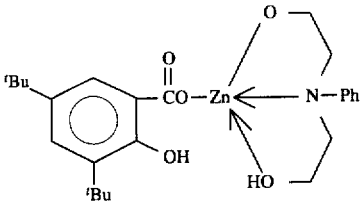
(XVIII)
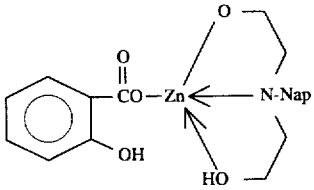
(XIX)
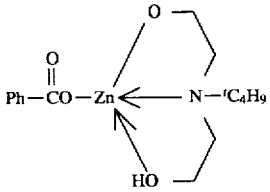

-continued

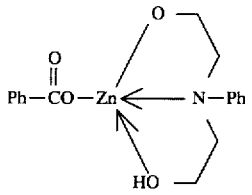

(XX)

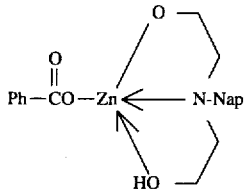

(XXI)

The following Examples are being provided to further illustrate various embodiments of the present invention, it being noted that these Examples are intended to illustrate and not limit the scope of the present invention. Parts and percentages are by weight unless otherwise indicated. Comparative Examples are also provided.

EXAMPLE I

The boron charge additive (IV) was prepared according to the following procedure.

In a magnetically stirred 1 liter round-bottom flask equipped with a Dean-Stark trap and a condenser were charged 30.48 grams (0.25 mole) of phenylboronic acid, 29.79 grams (0.25 mole) of N-methyl(bishydroxyethyl)amine and 500 milliliters of toluene. The resulting solution was then heated to reflux and heating was continued until the theoretical amount of water byproduct (0.5 mole, 9 milliliters) had been collected in the trap. Removal of toluene by rotary evaporation afforded a crude product which was recrystallized from acetone/hexane to yield the pure charge additive compound (IV). Overall yield was 49.9 grams (96 percent), m.p. 118° C.

EXAMPLE II

The boron charge additive (V) was prepared in accordance with the procedure of Example I except that N-t-butyl bis(hydroxyethyl)amine was utilized in place of N-methyl bis(hydroxyethyl)amine. The product was obtained in 87 percent yield, m.p. 199° C.

EXAMPLE III

The preparation of zinc charge additive (XV) was prepared according to the following procedure.

A mixture of 7.19 grams (0.025 mole) of zinc sulfate heptahydrate [$ZnSO_4.7H_2O$] and 6.26 grams (0.025 mole) of 3,5-di-tert-butylsalicylic acid in 200 milliliters of water was mechanically stirred and heated to 85° C. to 90° C. in a 1 liter round-bottomed flask fitted with a water condenser. To this reaction mixture was added in a dropwise fashion a solution of 8.95 grams (0.075 mole) of N-methyl bis(hydroxyethyl)amine in 50 milliliters of water over a period of 30 minutes. Subsequently, the reaction mixture was further stirred at the same temperature for another 2 hours, and then cooled down to about 50° C. and filtered. The grayish zinc compound was washed several times with water, and was dried in vacuo at 65° C. for 36 hours. The yield was 92 percent.

EXAMPLE IV

Zinc charge additive (XVII) was prepared in accordance with the procedure of Example III except that N-phenyl bis(hydroxyethyl)amine was utilized in place of N-methyl bis(hydroxyethyl)amine. The yield of was 89 percent.

EXAMPLE V

There was prepared in an extrusion device, available as ZSK-30 from Werner Pfleiderer, a toner composition by adding thereto 94.0 weight percent of a suspension polymerized styrene butadiene resin, reference U.S. Pat. No. 4,558,108, the disclosure of which is totally incorporated herein by reference, and 6.0 weight percent of REGAL 330® carbon black. The toner composition was extruded at a rate of 20 pounds per hour at a temperature of about 130° C. with a screw speed of 200 rpm. The strands of melt mixed product exiting from the extruder were air cooled, pelletized in a Berlyn Pelletizer and then fitzmilled in a Model J Fitzmill. The toner product was then subjected to grinding in a Sturtevant micronizer. Thereafter, the aforementioned toner particles were classified in a Donaldson Model B classifier for the purpose of removing fine particles, that is those with a volume average diameter of less than 4 microns. The resulting toner had a volume average particle diameter of 10.6 microns, and a particle size distribution of 1.22 as measured by a Coulter Counter. Subsequently, the toner was surface coated with 0.25 weight percent of boron additive (IV) as prepared in Example I by blending in a small coffee mill for 30 to 60 seconds.

The above treated toner was equilibrated at room temperature, about 25° C., under a 50 percent relative humidity condition for 24 hours. A developer was then prepared by blending 2.0 weight percent of the surface treated toner with 98.0 weight percent of carrier particles containing a nickel zinc ferrite core obtained from Steward Chemicals, and 0.9 weight percent of a polymer composite coating comprised of 80 weight percent of a methyl terpolymer and 20 weight percent of VULCAN XC72® carbon black. The methyl terpolymer was comprised of about 81 weight percent of polymethyl methacrylate and 19 weight percent of a styrene vinyltriethoxysilane polymer. The developer was roll milled for 30 minutes to generate the time zero developer, and the triboelectric charge of the toner of the resulting developer was measured to be −22.6 microcoulombs per gram by the standard blow-off technique in a Faraday Cage apparatus. To measure the rate of triboelectric charging of toner, 1.0 weight percent of the above uncharged toner was added to the time zero developer, and the charge distribution of the toner of the resulting developer was measured as a function of the blending time via roll milling using a charge spectrograph. The time required for the toner of the resulting developer to attain a charge distribution similar to that of the toner of the time zero developer was taken to be the rate of charging of the toner. For this toner, the rate of charging, or admix, was about 30 seconds.

EXAMPLE VI

A black toner with boron additive (V) of Example II as a surface charge enhancing additive was prepared in accordance with the procedure of Example V except that boron compound (V) was employed instead of boron compound (IV). A developer was then prepared from this toner accordingly. The toner had a triboelectric charge of −26.9 microcoulombs per gram, and a charging rate of about 45 seconds.

COMPARATIVE EXAMPLE (A)

A comparative black toner with a commercial charge enhancing additive, BONTRON E-88™ (obtained from Orient Chemicals), which is believed to be an aluminum complex comprised of an anion with two 3,5 -di-tert-butylsalicylic acid ligands bonded to a central aluminum atom, and a countercation of proton or alkaline metal ion was prepared by blending the untreated toner of Example V with 0.25 weight percent of BONTRON E-88™, and a developer was then prepared from this toner in accordance with the procedure of Example V. The toner exhibited a triboelectric charge of −40.4 microcoulombs per gram, and the rate of charging was measured to be about 5 minutes.

COMPARATIVE EXAMPLE (B)

A second comparative black toner was prepared by blending the untreated toner (no charge additive) of Example V with 0.25 weight percent of zinc(II) acetylacetonate of U.S. Pat. No. 5,409,794, and a developer was then prepared accordingly, and according to the above processes. The toner exhibited a triboelectric charge of −11.6 microcoulombs per gram, and its rate of charging, or admix, was about 120 seconds.

EXAMPLE VII

A black toner with 0.30 weight percent of zinc additive (XV) of Example III as a surface charge enhancing additive was prepared in accordance with the procedure of Example V except that zinc additive (XV) was employed instead of boron additive (IV). A developer was then prepared from this toner in accordance with the procedure of Example V. The toner displayed a triboelectric charge of −27.8 microcoulombs per gram, and its rate of charging was measured to be about 30 seconds.

COMPARATIVE EXAMPLE (C)

A comparative, black toner was prepared by blending the untreated toner of Example V with 0.30 weight percent of copper(II) acetylacetonate of U.S. Pat. No. 5,409,794, and a developer was then prepared from this toner accordingly. The toner exhibited a triboelectric charge of −22.3 microcoulombs per gram, and its rate of charging was about 2 minutes.

EXAMPLE VIII

A blue toner comprised of 97.0 weight percent of SPAR II polyester resin, 2.0 weight percent of PV FAST BLUE™ pigment, and 3.0 weight percent of zinc additive (XVII) of Example IV was prepared by melt blending these three components, followed by micronizing and classifying in accordance with the procedure of Example V. The resulting toner had a volume average particle diameter of 9.2 microns, and a particle size distribution of 1.27. A developer was prepared from this toner using 2.0 weight percent of toner and a carrier containing a steel core, and 0.8 weight percent of a polymer composite coating comprised of 80 weight percent of polymethyl methacrylate and 20 weight percent of VULCAN XC72™ carbon black. The toner displayed a triboelectric charge of −21.3 microcoulombs per gram, and its rate of charging was measured to be about 60 seconds.

The toner was then surface coated with 0.5 weight percent of AEROSIL R972® by a conventional dry blending method, and a developer was made from this toner and the same carrier particles as before. The triboelectric charge of this toner was measured to be −25.6 microcoulombs per gram, and its rate of charging was 30 seconds.

COMPARATIVE EXAMPLE (D)

A comparative blue toner and developer composition with zinc(II) 3-phenyl-2,4-pentanedionate of U.S. Pat. No. 5,409,794 was prepared in accordance with the procedure of Example VIII except that zinc(II) 3-phenyl-2,4-pentanedionate was utilized in place of the zinc additive (XVII). The toner displayed a triboelectric charge of −9.3 microcoulombs per gram, and its rate of charging was about 3 minutes.

Other modifications of the present invention may occur to those skilled in the art subsequent to a review of the present application, and these modifications, including equivalents thereof, are intended to be included within the scope of the present invention.

What is claimed is:

1. A negatively charged toner composition comprised of a polymer resin or polymer resins, colorants comprised of pigment particles and/or dyes, optional surface additives, and a boron charge enhancing additive obtained from the reaction of an alkylboric acid or an arylboric acid and an N-alkyl- or N-aryl-substituted bis(hydroxyalkyl)amine, or a zinc charge enhancing additive obtained from the reaction of an aromatic carboxylic acid and an N-alkyl- or N-aryl-substituted bis(hydroxyalkyl)amine with a zinc ion-containing compound in aqueous medium.

2. A negatively charged toner composition comprised of resin, pigment, optional surface additives, and a boron or zinc charge enhancing additive represented by the following formulas

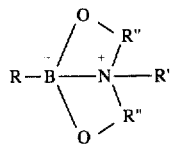

(Ia)

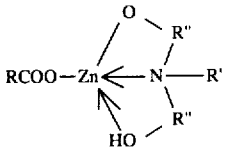

(Ib)

wherein R and R' are independently selected from the group consisting of alkyl and aryl; R" is alkylene with from one to about 5 carbon atoms; and B is boron.

3. A negatively charged toner composition in accordance with claim 2 wherein charge enhancing additive is represented by the following formulas

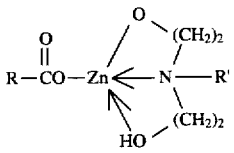

(II)

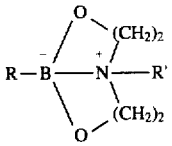

(III)

wherein R and R' are independently selected from the group consisting of alkyl with from 1 to about 25 carbon atoms, and aryl with from 6 to about 30 carbon atoms.

4. A toner composition in accordance with claim 2 wherein the boron charge additive is (IV), (V), (VI), (VII), (VIII), (IX), (X), (XI), (XII) or (XIII).

5. A toner composition in accordance with claim 2 wherein the zinc charge additive is (XIV), (XV), (XVI), (XVII), (XVIII), (XIX), (XX) or (XXI).

6. A toner composition in accordance with claim 2 wherein R is phenyl, tolyl or xylyl.

7. A toner composition in accordance with claim 2 wherein R' is alkyl containing from 1 to about 25 carbon atoms, or aryl containing from 6 to about 30 carbon atoms.

8. A toner composition in accordance with claim 3 wherein R and R' are independently selected from the group consisting of alkyl and aryl substituents containing from 1 to about 30 carbon atoms for alkyl, and 6 to about 24 carbon atoms for aryl.

9. A toner composition in accordance with claim 2 wherein the charge additive is present in an amount of from about 0.05 to about 5 weight percent.

10. A toner composition in accordance with claim 3 wherein the charge additive is present in an amount of from about 0.05 to about 5 weight percent.

11. A toner composition in accordance with claim 2 wherein the charge additive is incorporated into the toner, or wherein the charge additive is present on the surface of the toner composition.

12. A toner composition in accordance with claim 11 wherein the charge additive is contained on colloidal silica particles.

13. A toner composition in accordance with claim 2 with a negative triboelectric charge of from between about −10 to about −40 microcoulombs per gram.

14. A toner composition in accordance with claim 2 wherein the resin is a thermoplastic selected from the group consisting of styrene polymers, styrene acrylic polymers, styrene methacrylic polymers, polyesters, and mixtures thereof.

15. A toner composition in accordance with claim 2 further containing a wax component with a weight average molecular weight of from about 1,000 to about 7,000.

16. A toner composition in accordance with claim 3 further containing a wax component with a weight average molecular weight of from about 1,000 to about 7,000.

17. A toner composition in accordance with claim 15 wherein the wax component is selected from the group consisting of polyethylene polypropylene, or mixtures thereof.

18. A toner composition in accordance with claim 2 wherein the surface additives are metal salts of a fatty acid, colloidal silicas, or mixtures thereof.

19. A toner composition in accordance with claim 2 wherein the pigment is selected from the group consisting of carbon black, magnetites, cyan, magenta, yellow, red, blue, green, brown, and mixtures thereof.

20. A toner composition in accordance with claim 3 wherein the pigment is carbon black, magnetite, cyan, magenta, yellow, red, blue, green, or brown.

21. A developer composition comprised of the toner composition of claim 2 and carrier particles.

22. A developer composition in accordance with claim 21 wherein the carrier particle size ranges from about 20 to about 150 microns.

23. A developer composition in accordance with claim 21 wherein the carrier particles are comprised of ferrites, steel, or an iron powder with an optional polymer or mixture of polymers coating thereover.

24. A developer composition in accordance with claim 23 wherein the coating is comprised of a methyl terpolymer of styrene, n-butylmethacrylate and trivinylethoxysilane, a polyvinylidine fluoride, or a polymethyl methacrylate wherein R and R' are independently selected from the group consisting of alkyl and aryl; R" is methylene with from one to about 5 carbon atoms; and B is boron.

25. A toner in accordance with claim 2 wherein R and R' are independently selected from the group consisting of alkyl of from 1 to about 20 carbon atoms, and aryl of from 6 to about 30 carbon atoms; and R" is methylene, propylene, ethylene, butylene, or pentylene.

26. A toner in accordance with claim 25 wherein alkyl is methyl, ethyl, propyl, butyl, pentyl, hexyl, or heptyl, and aryl is phenyl, hydroxyphenyl, chlorophenyl, fluorophenyl, cyanophenyl, tolyl, or naphthyl.

* * * * *